US005998310A

United States Patent [19]

Bowen, Jr.

[11] Patent Number: 5,998,310

[45] Date of Patent: Dec. 7, 1999

[54] INDUSTRIAL FABRICS CONTAINING FINNED FIBERS DESIGNED TO RESIST DISTORTION

[76] Inventor: David Bowen, Jr., 9346 Old A1A, St. Augustine, Fla. 32086

[21] Appl. No.: 09/019,649

[22] Filed: Feb. 6, 1998

Related U.S. Application Data

[63] Continuation-in-part of application No. 08/752,198, Nov. 19, 1996, abandoned.

[51] Int. Cl.[6] ..... D02G 3/00

[52] U.S. Cl. ..... 442/196; 428/397; 139/383 A; 162/902

[58] Field of Search ..... 442/196; 428/397; 139/383 A; 162/902

[56] References Cited

U.S. PATENT DOCUMENTS

| | | |
|---|---|---|
| 4,633,596 | 1/1987 | Josef . |
| 5,097,872 | 3/1992 | Laine et al. . |
| 5,361,808 | 11/1994 | Bowen, Jr. . |
| 5,449,548 | 9/1995 | Bowen, Jr. . |

*Primary Examiner*—Elizabeth M. Cole

[57] ABSTRACT

Woven industrial fabrics which have an air permeability of at least 200 cfm per square foot under a pressure differential of 0.5 inches of water are described. These fabrics contain finned weft fibers with a shape factor of 2.5 to 5.0 and a distortion index of less than 35. Improved fabric stability and a significant reduction in weft fiber denier are achieved.

4 Claims, 2 Drawing Sheets

INDUSTRIAL FABRICS CONTAINING FINNED FIBERS DESIGNED TO RESIST DISTORTION

RELATED APPLICATIONS

This is a continuation in part of application Ser. No. 08/752,198 Nov. 19, 1996, now abandoned.

BACKGROUND OF THE INVENTION

In the production of paper and other industrial processes, woven and spiral link belts are often utilized to transport materials through the process. In papermaking, fabric belts have become highly specialized and different constructions are utilized in the several process stages. This invention is mostly directed toward fabric belts utilized in the dryer section of papermaking machines. This is where the pulp sheet is transported at high speed and held against steam heated rolls by the dryer belt or fabric. These fabric belts are still often called felts from their historical background, even though felts have long since been replaced by technically designed fabric constructions.

As the drying pulp sheet moves through this process section, it is transformed from a wet, delicate, low strength sheet into a full strength dried paper product. The dryer fabrics used at the input end of the process are exposed to more steam and lower temperatures than fabrics used at the output end of the process. These two conditions cause there to be a need for different fabric permeabilities and different fabric materials at the several dryer stages. There is a whole industry dedicated to supplying warp and weft fibers designed for fabrics used in papermaking and industrial production.

Most modern paper machine fabrics are constructed with thermoplastic warp and weft fibers made from materials stabilized against heat and humidity. Warps are usually round or ribbon shaped, while wefts are mostly round or of twisted filament construction. Warp fibers run in the machine direction and have few twisting forces during fabric onstruction. Weft fibers run in the cross machine direction and in most constructions have twist imparted into them during fabric weaving. There have been recent developments of hollow and shaped fibers targeted for use in dryer fabrics. Cost of the thermoplastic materials used to produce these fibers is an important consideration in fabric production.

DESCRIPTION OF THE PRIOR ART

As the demand for woven papermaker's and industrial fabrics moved toward thinner, reduced permeability fabrics, suppliers of such fabrics have shifted from use of round monofilament wefts to use of twisted and cabled weft fiber constructions which have more capability to conform into the interstitial spaces formed at the crossings of warp and weft fibers. This shift has been moderately successful in regards to production of lower fabric permeabilities, but at the expense of higher cost and the tendency to quicker fabric soiling. Other negative factors associated with these cabled, smaller monofilaments is that they tend to degrade more rapidly under harsh environmental conditions. The words "fibers and filaments" are used interchangeably in this description except where special notations and distinctions are made.

There has also been a shift toward more ribbon shaped warp filaments. These fibers have a width from one to three times their thickness and reduce permeability by the fact that the extra warp fiber width decreases the number of places where there are open warp and weft intersections. One drawback to this practice is that the warp and weft intersections tend to give the fabric stability through small interfilament distortions which occur at these intersections. A less significant additional problem with these ribbon warp monofilaments is their slightly increased failure due to wear.

Recently, Baker et. al. in U.S. Pat. No. 5,597,450 introduced the application of hollow weft fibers to papermaker's fabrics. The claimed advantages are that the fiber conforms readily to the interstitial spaces of the fabrics and results in low permeabilities and good fabric stability.

Fabric stability is improved by increasing the interaction between warp and weft fibers. As each weft fiber pick is inserted into the fabric, it is beaten against the warp fibers so that the warp fibers take on a sinusoidal crimp. The weft fibers remain relatively flat, with minor distortions and indentations where the warp fibers have been mechanically impacted against them. Monofilament solid round weft fibers usually have low weaving distortion, which results in reduced interlocking with warp fibers and reduced fabric stability. The warp fibers take on a distinct sinusoidal crimp during weaving as a result of being beaten against the weft fibers and being required to go over and under the weft fibers in the weaving pattern. Increased fabric stability is now achieved by methods such as increased pick count, use of multifilament weft fibers, use of cabled weft fibers and application of resinous fabric treatments. These methods are effective in selected areas, but all carry a cost or performance penalty which prevent them from being generally acceptable.

There has also been activity in the area of using shaped filaments and filaments which significantly distort to achieve smooth fabric surfaces, fabric stability and controlled fabric air permeability.

Fabric permeability is usually expressed as the flow rate of air expressed as cubic feet per minute (cfm) through one square foot of fabric under a pressure of 0.50 inches of water. Fabrics are roughly classified as high permeability with flow rates above 500 cfm, low permeability with flow rates below 200 cfm, and intermediate permeability between 200 and 500 cfm.

In U.S. Pat. No. 5,097,872, Laine et. al. teach the use of an X shaped monofilament which has a substantially flattened x-shaped configuration from being deformed during weaving, where a relatively flat outer surface is formed. This flat outer surface is desirable for production of smooth paper products. The bending forces which he describes as contributing to flattening would occur in warp fibers as they bend around the weft fibers. These bending forces would not be present to contribute to flattening of weft fibers. Weft fibers lie almost flat in the cross machine direction of woven fabrics.

In U.S. Pat. No. 4,633,596, Josef teaches the use of warp fibers having a center thinner than the edges and which improves fabric dimensional stability by minor distortion at warp and weft crossings. This is in marked contrast to the use of finned weft filaments which are by design thicker in their center than at their edges and which run in the cross machine direction to warp fibers in woven fabrics. The drawings and designs shown in Josef's patent would tend to produce fabrics having medium to high permeability.

In U.S. Pat. No. 5,361,808, Bowen teaches the use of finned weft fibers whose fins are deflected at the intersections of the warp and weft, but which fins remain extended to block fabric interstitial space where not mechanically contacted by other fibers. This patent is incorporated into this application by reference. The fins of the described fibers are specifically designed to promote bending. FIG. 7 and the detailed description of this patent concept show the extent of distortion expected and explain the mechanisms used to obtain distortion. Examples of long thin fins and use of plasticizers are given. A limiting lower shape factor of 5.0 is also specified. Shape factor is defined as the ratio of the diameter of a circle circumscribing the filament to the average thickness of the fins. For example, a filament having a circumscribing diameter of 0.50 mm and fins 0.08 mm thick would have a shape factor of 6.25. For tapered fins, the average thickness of the fins would be the linear average thickness. For more complicated shapes, geometric solutions such as the fin area divided by the fin length could be used to calculate the average fin thickness.

In U.S. Pat. No. 5,449,548, Bowen extends the concept of shaped finned fiber use in industrial fabrics by addressing new and novel ways to make the fins easier to distort. This patent is incorporated into this application by reference. Tapered fins and fins with thickness reducing notches are given as methods to promote conformation of the finned fibers into the interstitial spaces of woven and spiral fabrics.

At the same time as this shift toward thinner, low permeability fabrics has been occurring on new, faster running paper machines, there has also been generated a need for high performance, soil shedding fabrics of intermediate permeability on the large number of existing paper machines. Intermediate permeabilities have also been found to be desirable on stages of the faster machines where high steam generation is created.

SUMMARY OF THE INVENTION

The present invention provides stable, controlled medium and high permeability papermaking or industrial fabrics, especially dryer fabrics, with the capability of being easily produced on standard industrial looms through use of new weft fiber designs. Generally these new weft fibers will be monofilaments, but there may be uses where these designs will be used in combinations with other round or shaped fibers in a bundled arrangement. These new weft fiber designs will be produced from any of a variety of thermoplastic fiber forming materials such as, but not limited to, nylon-6, nylon-66, polyethylene terphthalate, polyphenenylene sulphide or 1,4-polydicyclohexanol terphthalate. General requirements for the polymer used to form the weft fibers are that the polymer be stable against steam hydrolysis, stable against steady exposure to temperatures in the range of 130 to 160 degrees Centigrade and resist wear from the paper sheet. Many of these fiber forming thermoplastics are available with standard recipes which include heat and hydrolysis stabilizers. Plasticizing agents are also sometimes employed for use in brittle fiber forming plastics. The major use of the concept is projected for monofilaments having a denier greater than 100, but up to 12 monofilaments could be combined to form useful products for industrial fabrics.

One of the key elements to the design of these fibers is their finned structure. They may appear to have cross sections which resemble X, Y, T, * or star shapes. It will not be necessary for the shape to be symmetrical. Each of these fibers will have a central area from which the fins protrude outwardly in a roughly radial direction. Another key element for this invention is the short stubby fin design. A shape factor of 2.5 to 5.0 has been found to be the best range for the weft fibers of this invention.

Modifications to the customary techniques for manufacturing round fibers are usually required to produce these finned fibers. The angular intersection of the fin with the fiber center results in a place for water to collect. This water can interfere with heating of the fiber in subsequent processing stages if it is not removed. Air streams designed to impinge on the fibers and blow the water away have been found to be very effective at removing this water. If water is not removed properly, the fibers will usually have an unacceptable number of thick "nubs" along their length. Control of spinning temperature of the polymer at the spinneret needs be carefully controlled to obtain good fiber size control. Temperature excursions greater than +/−2 degrees centigrade are usually troublesome for good fiber production.

By maintaining the fiber shape factor between 2.5 and 5.0, it was unexpectedly found that fabrics having permeabilities in the intermediate range of 200 to 500 cfm could be produced which used 30 percent less weight of weft fiber and which had improved fabric stability. The short stubby fins produced at this shape factor range would not bend and crush nearly to the extent shown by fins on fibers produced by the technologies of U.S. Pat. Nos. 5,361,808 and 5,449,548. It will be possible to easily produce fabrics with permeabilities above 500 cfm with these fibers by using a reduced pick count, but it is expected that the improved fabric stability for the intermediate permeability range will be most useful.

BRIEF DESCRIPTION OF THE DRAWINGS

FIG. 9 shows this process for two of the fins on the weft fiber shown and the resulting distortion angles A and B. Both angles A and B are about 30 degrees.

In FIG. 10 the distortion angles are about 110 degrees. In FIG. 11, angle A is about 85 degrees and angle B is about 125 degrees.

Figure 8:
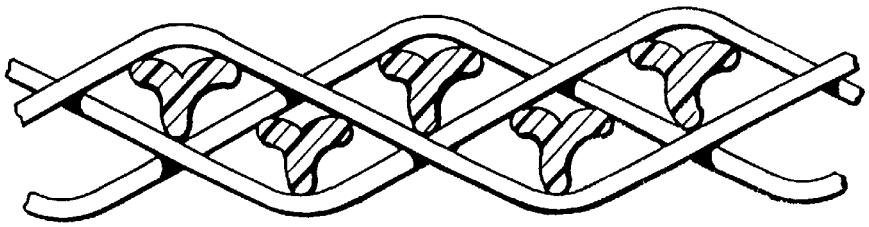
FIG. 8 shows a side view of a woven fabric containing Y shaped monofilament weft filaments which are slightly distorted by the warp as it passes over and under the weft fibers. Note the sinusoidal pattern of the warp fibers.
Figure 9:
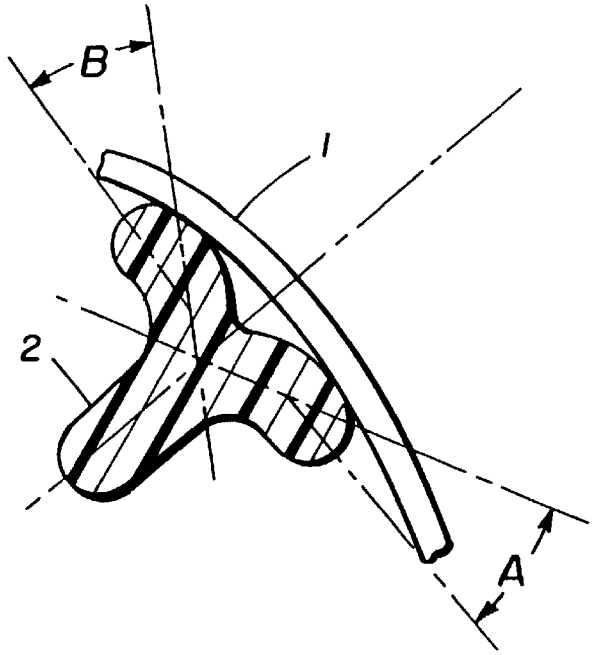
FIG. 9 shows one of the Y shaped weft fibers 2 that has been slightly distorted by a warp fiber 1. Note that the distortion is shown relative to a line extending outwardly from the fiber center in the direction where the previously undistorted fin's tip center would lie. By microscopic observation of the distorted wefts in woven fabrics, it is usually easy to ascertain the place on the fin where the distortion begins. The shape of the undistorted fiber is also known and the original angles of the fins are known. A line is drawn from the radial point on the fin where it is determined that distortion began, originating at the intersection of the undistorted fin's center line described previously and the beginning point of the distortion and extending through the center of the distorted fin tip.
Figure 10:
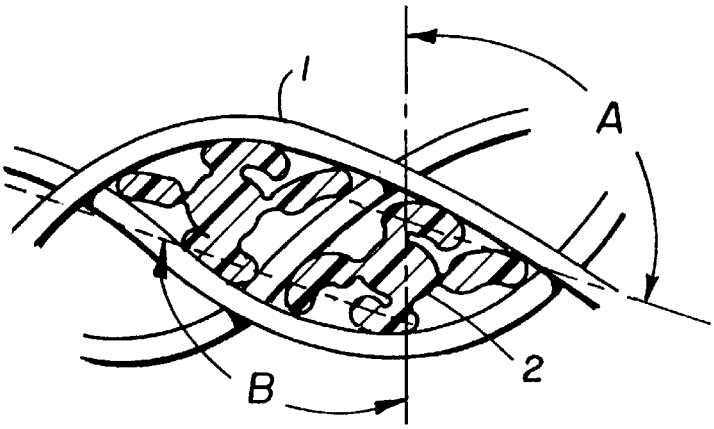
FIGS. 10 and 11 show typical distortion of fins resulting from weaving of weft fibers having 4 fins and notched fins in FIG. 10, and tapered fins in FIG. 11.
Figure 11:
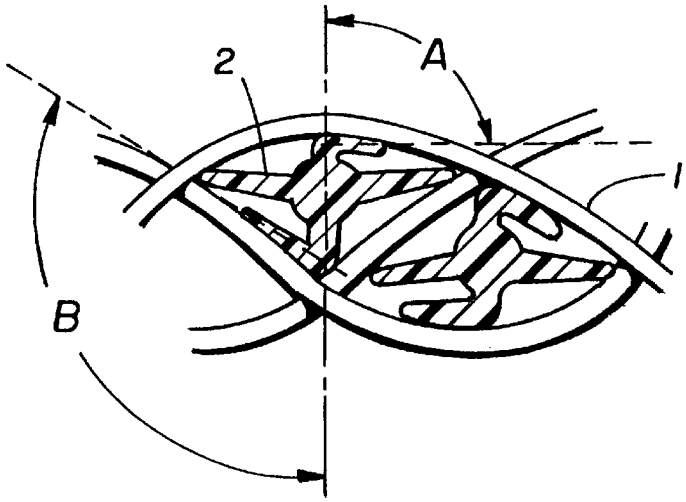

Of special import is the fact that in FIG. 8, it is shown that the relatively undistorted weft fibers do not block the interstitial spaces of the fabric, while in FIGS. 10 and 11, the highly distorted weft fibers block the fabric interstitial spaces.

DETAILED DESCRIPTION OF THE INVENTION

The finned weft filaments used in the fabrics of the present invention can be prepared from many fiber forming thermoplastics which have a melt point above 200 degrees centigrade. Polyethylene terphthalate, polyphenylene sulphide, nylon 6, and nylon 66 are representative but not limiting examples of such materials. Use of additive recipies which may include heat and hydrolysis stabilizers, contaminant release agents and other processing aids common to production of papermaker's fibers is considered as standard.

The fiber forming process modifications mentioned in the summary to prevent retained water droplets from causing nubs in the fibers should be carefully considered. Since the denier of these fibers is high, typically from 100 to 6000, they are most often water quenched at speeds of 20 to 100 feet per minute, stretched by a ratio of 3 to 5, and relaxed by 5 to 25 percent. Depending on the polymer viscosity and the height of the spinneret above the quench water, there is generally a size reduction of 3 to 10 between the spinneret hole size and the resulting fiber. Shaped fiber production demands improved polymer viscosity control over that acceptable for round fibers. This is usually done through slightly longer polymer drying times with temperatures within +/−5 degrees centigrade and extrusion temperature control within +/−2 degrees centigrade.

Beside fabric permeability which was described in the background of the invention, another major property of industrial fabrics is fabric stability which is measured by fabric deflection methods. Several different techniques are used to measure this property of industrial fabrics, but most basically consist of mounting a rectangular piece of fabric in a flexible frame and determining how much the fabric deflects when a force is exerted on one side. In most instances a lower deflection is better, indicating good binding interaction between the warp and weft fibers.

Figure 1:
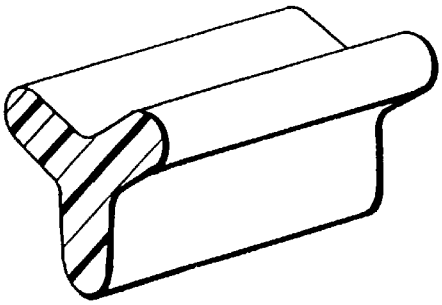
FIG. 1 is a cross sectional perspective view of one preferred embodiment for a Y shaped filament.
Figure 2:
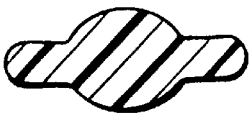
FIG. 2 is a cross sectional view of a filament having an oval core and two fins.
Figure 3:
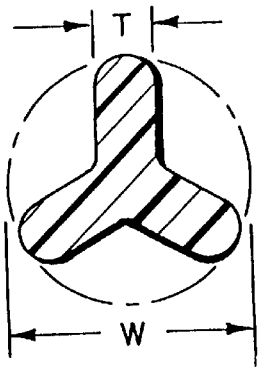
FIG. 3 shows a Y shaped filament with the elements necessary to calculate shape factor indicated. The circle diameter necessary to contain the filament has a diameter of W. The fin thickness is shown as T. The shape factor is W divided by T. If the fin had been tapered instead of straight sided, geometric principles could be used to determine the average fin width.
Figure 4:
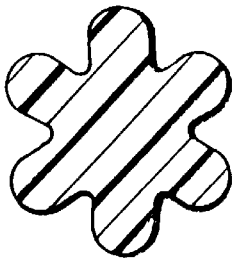
FIG. 4 shows an asterisk shaped filament.
Figure 5:
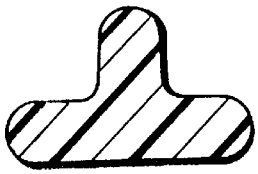
FIG. 5 shows an inverted T shaped filament.
Figure 6:
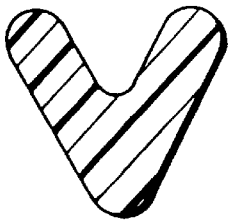
FIG. 6 shows a V shaped filament.
Figure 7:
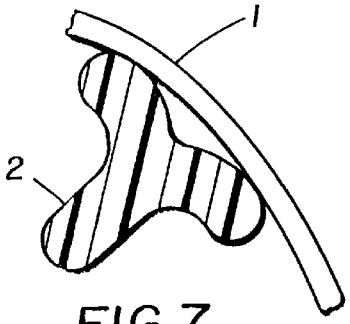
FIG. 7 shows a Y shaped filament 2, which is in contact with a warp fiber shown as 1. Note that the fins of the Y shape are slightly deflected against the warp.

The way to measure distortion angles was covered in the brief description of the drawings. It is understood that this will not be an exacting measurement, since the point of bending will be a judgement call. The need for more precision is unnecessary since the deflection behavior of fibers of this invention are so different from those of previous patents. The deflection index of a finned fiber will be defined as the sum of the individual fin deflection angles divided by the number of fins on that fiber. The fibers of this invention will have a deflection index of less than 35 degrees. By contrast, the fibers of several other patents have much higher deflection indices, Laine's fibers have at least a deflection index of 45 since a flat surface is produced on the outer side and the tips of the non flattened side are bent by 45 degrees. A 90 degree X starts with all fins radiating at 45 degree angles from a line parallel to the base of the X and passing through the center of the X. Bowen in U.S. Pat. No. 5,361,808, FIG. 7, shows 2 fins bent 90 degrees and 2 fins relatively undistorted. This results in a distortion index of 180/4=45. Bowen in U.S. Pat. No. 5,449,548 shows woven fabric fins bent 90, 15, 110 and 0 degrees for a deflection index of 215/4=53.75.

One of the benefits to having the shape factor between 2.5 and 5.0 is that the fin stiffness prevents these major fin distortions and the problem of fin splitting is almost non-existent. The use and advantages of the invention will be illustrated by the following examples.

1. A papermakers dryer fabric is woven utilizing a warp yarn with dimensions of 0.35 by 0.53 mm with 53 ends per inch and a round weft yarn 0.50 mm in diameter inserted at 32 picks per inch. Permeability is measured at 425 cfm and fabric deflection is 0.90 inch. Denier of this weft is 2200 and the cost is $2.60 per pound.
2. A papermaker's dryer fabric is woven utilizing a warp yarn with dimensions of 0.35 mm by 0.53 mm with 53 picks per inch and a four finned weft fiber with a circumscribing diameter of 0.60 mm and fin thickness of 0.15 mm. This is a shape factor of 4.0. Permeability is determined to be 460 cfm and fabric deflection is 0.73 inch. Denier of this weft is 1150 and the cost is $2.80 per pound. Net cost to the weaver for the X shaped weft is (1150/2200)×(280/260)=0.56 the cost of the round weft. Deflection index for the weft fibers is 27.
3. A papermaker's dryer fabric is woven utilizing a warp yarn as in examples 1 and 2 above but a Y shaped weft fiber with a circumscribing diameter of 0.60 and a shape factor of 4.0. This means that the fins here are also 0.15 mm thick. Denier of the weft is 875 and its cost is $2.95 per pound. It should be noted that the cost reflects the lower output of the fiber spinning machine unless additional winders are brought into service. Permeability is determined to be 490 cfm and fabric deflection is 0.80 inch. Net cost to the weaver for the Y shaped weft is (875/2200)×(295/260)=0.45 that of the round weft. Deflection index for the weft is 30.
4. A papermaker's dryer fabric is made as in 2 above except that 34 picks per inch were used. Permeability was determined to be 420 cfm and fabric deflection was reduced to 0.70 inch. Cost for the weft fibers in this construction is (0.56)×(34/32)×34/32 (loom costs) the cost of the round example of example 1. Deflection index for the weft is 31.

It is therefore shown that the use of finned weft fibers offer fabric results compatible to those obtained from the use of round weft fibers and at a considerable decrease in material consumption.

It is pointed out that these fibers do not usually form a significant part of the fabric surface, being held in the fabric interior by warp fibers. There will also not be any significant flat surfaces generated on the sides of these fibers by bending and weaving forces. Weft fibers do not take on the sinusoidal shape common to warp fibers, and lie relatively flat within the fabric.

What is claimed is:

1. A woven papermaker's fabric having a permeability greater than 200 cfm where at least 20 percent of the weft fibers contained within said papermaker's fabric have fins:

a) said weft fibers with fins having a shape factor between 2.5 and 5.0;

b) said weft fibers having a deflection index of less than 35 c) said weft fibers having a denier greater than 100;

d) said weft fibers formed from thermoplastics having a melt temperature above 200 degrees centigrade whereby weft fiber cost for said papermaker's fabric may be reduced by more than 25 percent when compared to round weft fibers giving the same fabric permeability and fabric deflection.

2. The woven papermaker's fabric of claim 1 where the denier of the finned weft fibers is between 300 and 2500.

3. The woven papermaker's fabric of claim 1 where the finned weft fiber has between 2 and 6 fins.

4. The woven papermaker's fabric of claim 1 where the fins of the finned weft fiber are not symmetrical.

* * * * *